US010493414B2

(12) United States Patent
Ahmad et al.

(10) Patent No.: US 10,493,414 B2
(45) Date of Patent: Dec. 3, 2019

(54) BEVERAGE STIRRING ASSEMBLY

(71) Applicants: A Hakeem Ahmad, Canfield, OH (US); Shadia Ahmad, Canfield, OH (US)

(72) Inventors: A Hakeem Ahmad, Canfield, OH (US); Shadia Ahmad, Canfield, OH (US)

( * ) Notice: Subject to any disclaimer, the term of this patent is extended or adjusted under 35 U.S.C. 154(b) by 0 days.

(21) Appl. No.: 15/387,229

(22) Filed: Dec. 21, 2016

(65) Prior Publication Data

US 2018/0169599 A1 Jun. 21, 2018

(51) Int. Cl.

| | |
|---|---|
| ***B01F 15/00*** | (2006.01) |
| ***B01F 7/00*** | (2006.01) |
| ***B01F 7/20*** | (2006.01) |

(52) U.S. Cl.

CPC .... *B01F 15/00506* (2013.01); *B01F 7/00733* (2013.01); *B01F 7/20* (2013.01); *B01F 15/00798* (2013.01); *B01F 2015/00084* (2013.01); *B01F 2015/00597* (2013.01); *B01F 2215/0022* (2013.01)

(58) Field of Classification Search

CPC ..... B01F 15/00506; B01F 15/00798; B01F 7/00733; B01F 7/20; B01F 2015/00597

USPC ..... 366/247

See application file for complete search history.

(56) References Cited

U.S. PATENT DOCUMENTS

| | | | | |
|---|---|---|---|---|
| 1,174,828 | A * | 3/1916 | Copeland | B01F 11/0082 366/256 |
| 1,660,606 | A | 2/1928 | Evans | |
| D181,143 | S | 10/1957 | Gundelinger | |
| 5,938,332 | A * | 8/1999 | Bachellier | B01F 7/00341 366/330.1 |
| 7,370,770 | B2 | 5/2008 | Chomik | |
| 8,365,941 | B2 | 2/2013 | Mayer | |
| D700,008 | S | 2/2014 | Ehrenhaus | |
| 2007/0253282 | A1* | 11/2007 | Dalton | B01F 7/00341 366/201 |
| 2009/0147615 | A1* | 6/2009 | Parias Cruz | A47J 43/1018 366/130 |
| 2012/0008455 | A1* | 1/2012 | Sand | A61B 17/8833 366/130 |
| 2014/0060337 | A1 | 3/2014 | Varnum | |
| 2015/0374175 | A1* | 12/2015 | Garr | A47J 43/27 366/130 |

FOREIGN PATENT DOCUMENTS

| | | |
|---|---|---|
| WO | WO2013010568 | 1/2013 |

* cited by examiner

*Primary Examiner* — Marc C Howell

(57) ABSTRACT

A beverage stirring assembly for selectively stirring a liquid in a container includes a container that may contain a liquid. A stirring unit is removably coupled to the container and the stirring unit is selectively manipulated. The stirring unit stirs the liquid when the stirring unit is manipulated. Moreover, the stirring unit is selectively removed from the container thereby facilitating an interior of the container to be washed.

7 Claims, 4 Drawing Sheets

BEVERAGE STIRRING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to stirring devices and more particularly pertains to a new stirring device for selectively stirring a liquid in a container.

BRIEF SUMMARY OF THE INVENTION

An embodiment of the disclosure meets the needs presented above by generally comprising a container that may contain a liquid. A stirring unit is removably coupled to the container and the stirring unit is selectively manipulated. The stirring unit stirs the liquid when the stirring unit is manipulated. Moreover, the stirring unit is selectively removed from the container thereby facilitating an interior of the container to be washed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
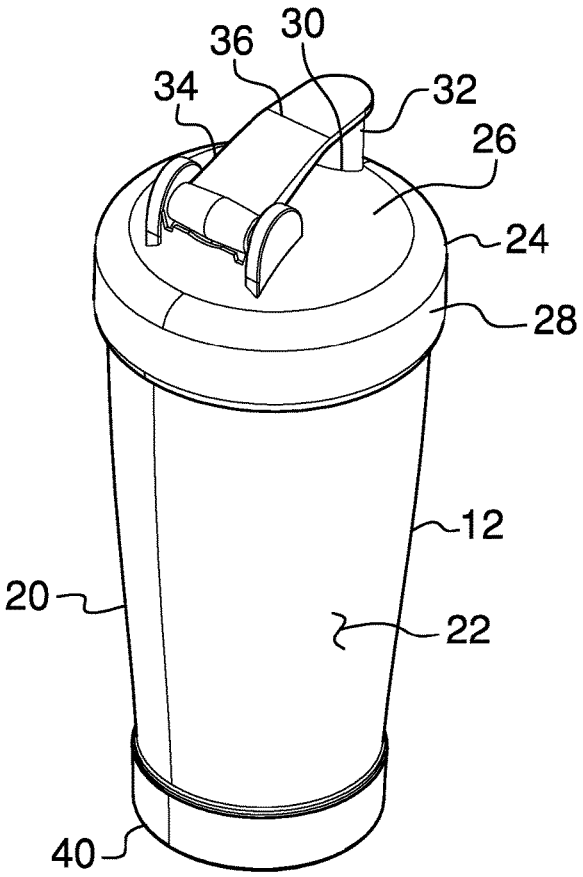
FIG. 1 is a perspective view of a beverage stirring assembly according to an embodiment of the disclosure.
Figure 2:
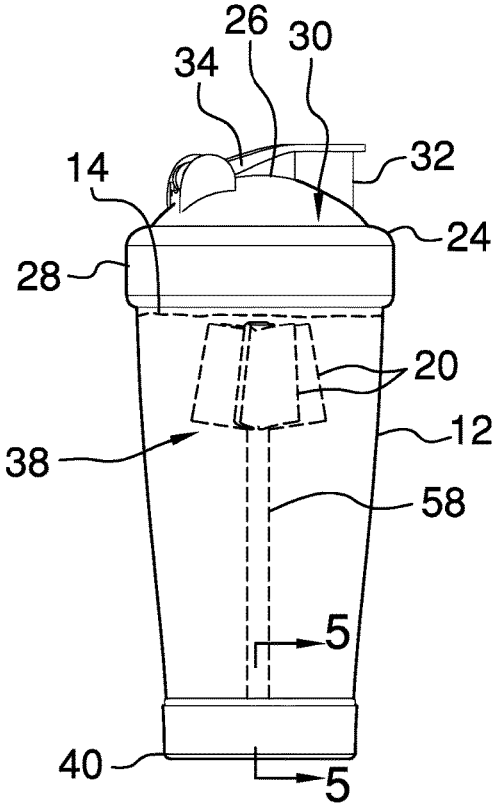
FIG. 2 is a front phantom view of an embodiment of the disclosure.
Figure 3:
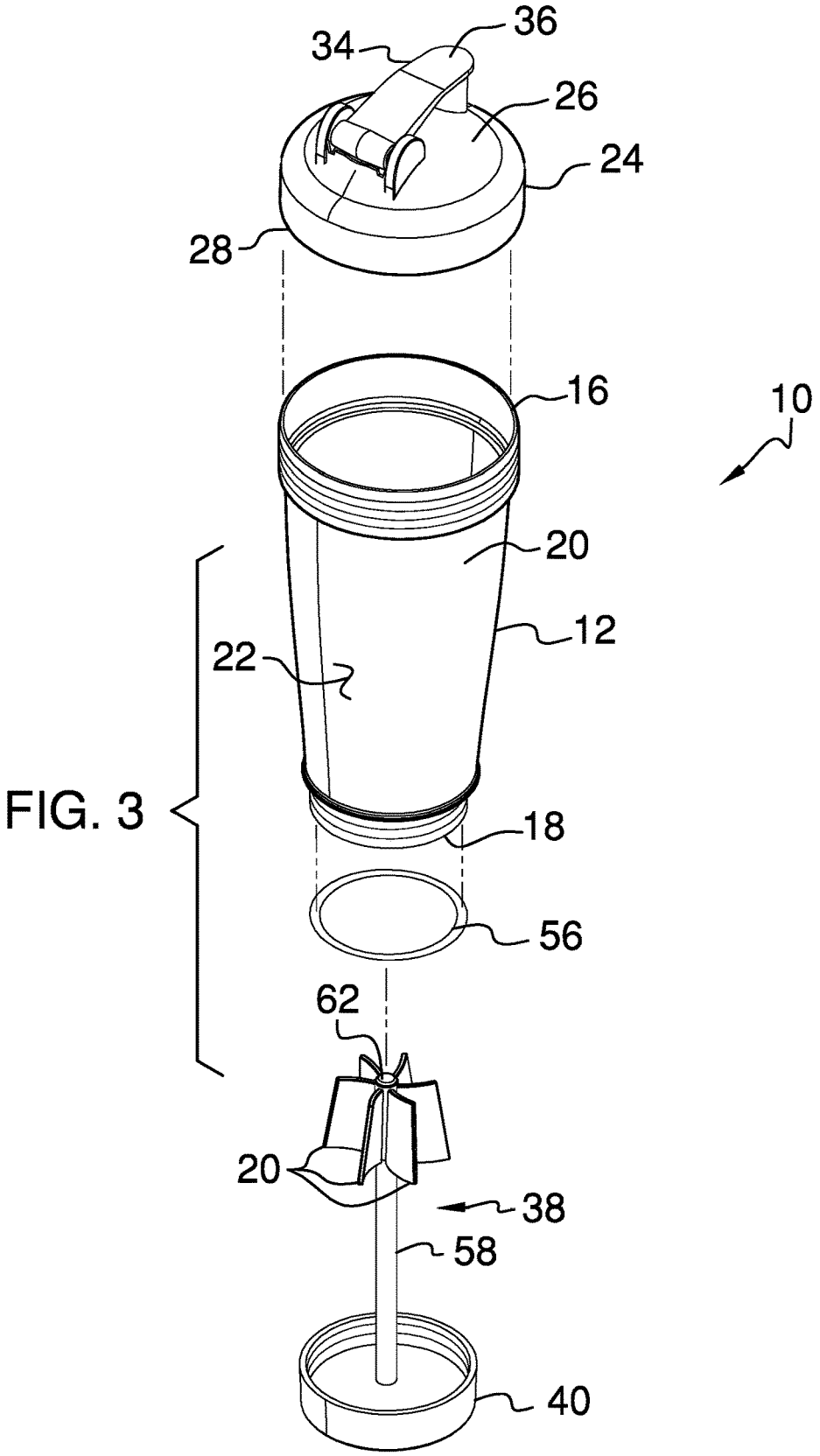
FIG. 3 is an exploded perspective view of an embodiment of the disclosure.
Figure 4:
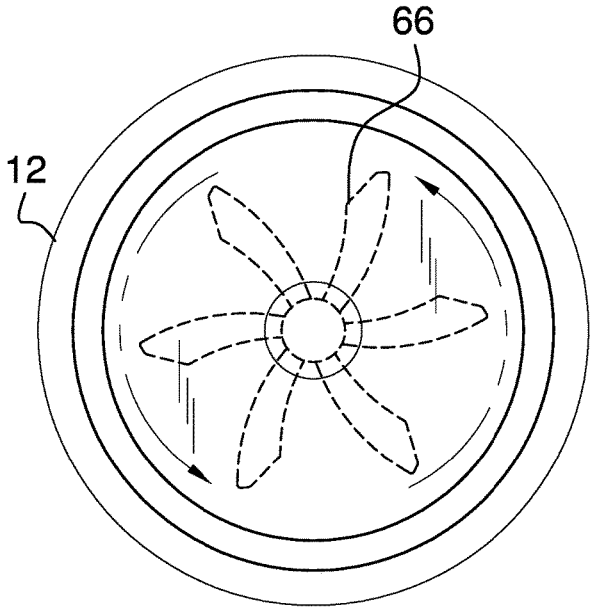
FIG. 4 is a bottom phantom view of an embodiment of the disclosure.
Figure 5:
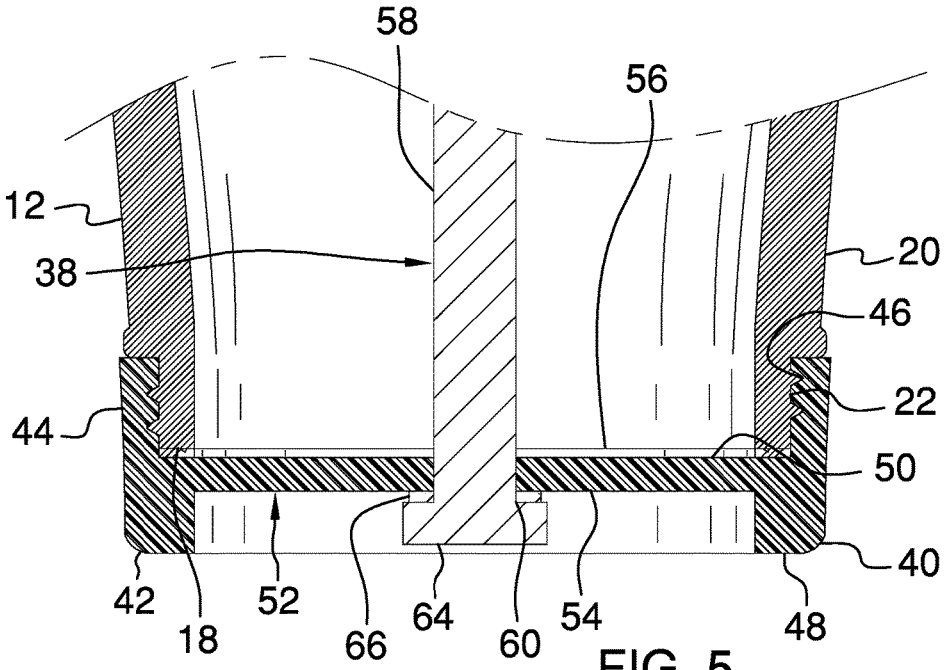
FIG. 5 is a cross sectional view taken along line 5-5 of FIG. 4 of an embodiment of the disclosure.

With reference now to the drawings, and in particular to FIGS. 1 through 6 thereof, a new stirring device embodying the principles and concepts of an embodiment of the disclosure and generally designated by the reference numeral 10 will be described.

As best illustrated in FIGS. 1 through 6, the beverage stirring assembly 10 generally comprises a container 12 that may contain a liquid 14. The liquid 14 may be a beverage such as coffee, tea, a sports drink or any other consumable beverage. The container 12 has a top end 16, a bottom end 18 and an outer wall 20 extending therebetween. Each of the top end 16 and the bottom end 18 is open and the outer wall 20 has an outer surface 22. The outer surface 22 is threaded adjacent to the bottom end 18 and the outer surface 22 is threaded adjacent to the top end 16. The outer wall 20 flares outwardly between the bottom end 18 and the top end 16.

A first lid 24 is provided and the first lid 24 is removably coupled to the container 12. The first lid 24 has a first wall 26 and a perimeter wall 28 extending downwardly therefrom. The perimeter wall 28 threadeably engages the top end 16 of the container 12. The first lid 24 has an aperture 30 extending through the first wall 26 to pass the liquid 14 therethrough thereby facilitating the liquid 14 to be drinkable. A spout 32 may be coupled to the first lid 24 and the spout 32 may be aligned with the aperture 30. Thus, the liquid 14 may be consumed through the spout 32.

A closure 34 is movably coupled to the first lid 24 and the closure 34 is selectively manipulated. The closure 34 is selectively positioned between an open position and a closed position. Moreover, the closure 34 closes the aperture 30 in the first lid 24 when the closure 34 is positioned in the closed position. The closure 34 may include a lever 36 that is hingedly coupled to the first lid 24. The lever 36 may engage the spout 32 when the closure 34 is in the closed position thereby inhibiting the liquid 14 from passing through the spout 32.

A stirring unit 38 is provided and the stirring unit 38 is removably coupled to the container 12. The stirring unit 38 may be manipulated thereby facilitating the stirring unit 38 to stir the liquid 14. Additionally, the stirring unit 38 is selectively removed from the container 12 thereby facilitating an interior of the container 12 to be washed.

The stirring unit 38 comprises a second lid 40 that has a primary wall 42 and a peripheral wall 44 extending upwardly therefrom. The peripheral wall 44 has an inside surface 46 and the inside surface 46 threadably engages the bottom end 18 of the container 12. In this way the second lid 40 is removably coupled to the container 12. The primary wall 42 has a first surface 48 and a second surface 50. The first surface 48 has a well 52 extending toward the second surface 50 and the well 52 has a bounding surface 54.

A first gasket 56 is positioned on second surface 50 of the second lid 40 and the first gasket 56 is coextensive with the peripheral wall 44. The first gasket 56 may be comprised of a resiliently compressible material such as rubber or the like. In this way the first gasket 56 forms a fluid impermeable seal between the second lid 40 and the container 12 when the second lid 40 is removably coupled to the container 12.

A shaft 58 is provided that has a first end 60 and a second end 62. The shaft 58 extends through the primary wall 42 of the second lid 40 having the shaft 58 extending upwardly into the container 12 when the second lid 40 is removably coupled to the container 12. A knob 64 is coupled to the first end 60 of the shaft 58 and the knob 64 may be manipulated. The knob 64 is spaced from the first surface 48 of the second lid 40 thereby inhibiting the shaft 58 from passing through the second lid 40.

A second gasket 66 is positioned around the shaft 58. The second gasket 66 may be comprised of a resiliently compressible material such as rubber or the like. The second gasket 66 is compressed between the knob 64 and the first surface 48 of the second lid 40. In this way the second gasket 66 forms a fluid impermeable seal between the second lid 40 and the knob 64.

Figure 6:
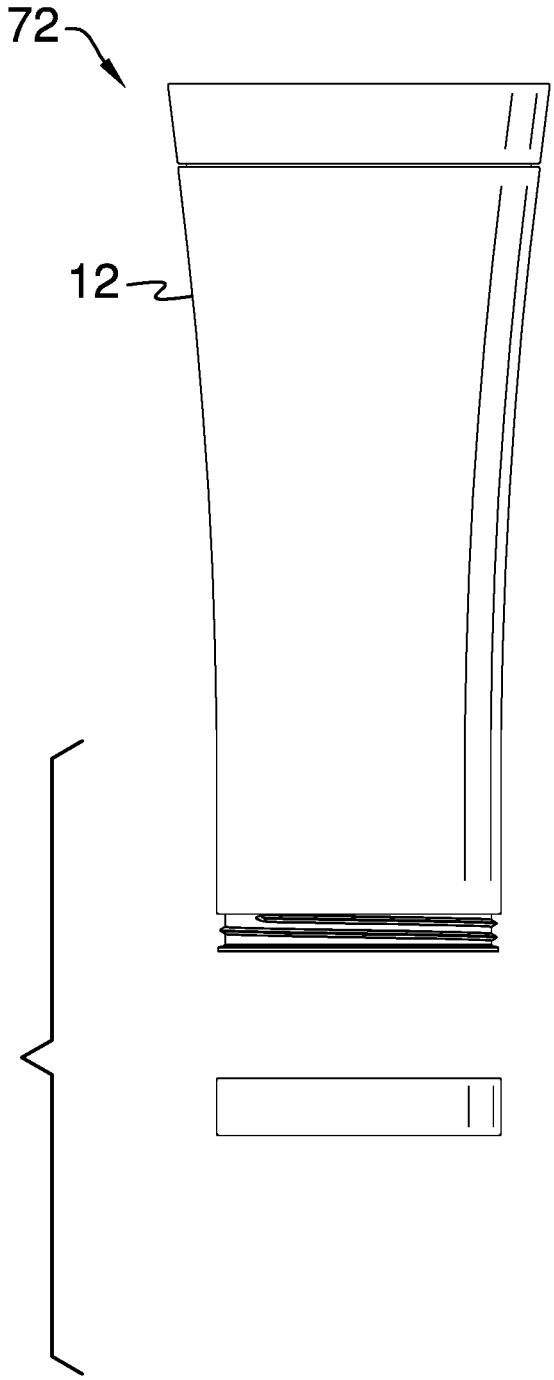
FIG. 6 is an exploded perspective view of an alternative embodiment of the disclosure.

An agitator 68 is provided and the agitator 68 is coupled to the second end 62 of the shaft 58. The agitator 68 comprises a plurality of fins 70 and each of the fins 70 radiates outwardly from the shaft 58. Each of the fins 70 agitates the liquid 14 in the container 12 when the knob 64 is manipulated. In an alternative embodiment 72 as shown in FIG. 6, the stirring unit 38 may be replaced with a removable lid.

In use, the second lid 40 is removably coupled to the bottom end 18 of the container 12 and the container 12 is filled with the liquid 14. The first lid 24 is removably coupled to the container 12 and the closure 34 is opened to facilitate the liquid 14 to be consumed. The knob 64 is selectively manipulated to stir the liquid 14 in the container 12. Each of the first lid 24 and the second lid 40 are removed from the container 12 to clean an interior of the container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A beverage stirring assembly being configured to contain a beverage for drinking, said assembly comprising:

a container being configured to contain a liquid, said container having a top end, a bottom end and an outer wall extending therebetween, each of said top end and said bottom end being open, said outer wall having an outer surface, said outer surface being threaded adjacent to said bottom end, said outer surface being threaded adjacent to said top end, said outer wall flaring outwardly along a full length between said bottom end and said top end;

a first lid being removably coupled to said container;

a stirring unit being removably coupled to said container wherein said stirring unit is configured to be manipulated thereby facilitating said stirring unit to stir the liquid, said stirring unit being selectively removed from said container thereby facilitating an interior of said container to be washed, said stirring unit including a second lid having a primary wall and a peripheral wall extending upwardly therefrom, said peripheral wall having an inside surface, said inside surface threadably engaging said bottom end of said container such that said second lid is removably coupled to said container;

a shaft having a first end and a second end, said shaft extending through said primary wall of said second lid having said shaft extending upwardly into said container when said second lid is removably coupled to said container;

a knob being coupled to said first end of said shaft wherein said knob is configured to be manipulated, said knob being spaced from said first surface of said second lid thereby inhibiting said shaft from passing through said second lid; and an agitator being coupled to said second end of said shaft, said agitator comprising a plurality of fins, each of said fins having a long side coupled to said shaft such that each of said fins radiates outwardly from said shaft wherein each of said fins is configured to agitate the liquid in said container when said knob is manipulated, each of said fins having a respective top edge and a respective bottom edge, said top edges of said fins each being straight and upwardly angled extending away from said shaft, said bottom edges of said fins each being straight and upwardly angled extending away from said shaft, each of said fins tapering from said bottom edge to said top edge wherein a smallest diameter of said agitator is positioned adjacent to said top end where an interior diameter of said container is greatest, each of said top edges and said bottom edges being arcuate.

2. The assembly according to claim 1, further comprising said first lid having a first wall and a perimeter wall extending downwardly therefrom, said perimeter wall threadeably engaging said top end of said container, said first lid having an aperture extending through said first wall wherein said aperture is configured to pass the liquid therethrough thereby facilitating the liquid to be drinkable.

3. The assembly according to claim 2, further comprising a closure being movably coupled to said first lid wherein said closure is configured to be manipulated, said closure being selectively positioned between an open position and a closed position, said closure closing said aperture in said first lid when said closure is positioned in said closed position.

4. The assembly according to claim 1, wherein said primary wall has a first surface and a second surface, said first surface having a well extending toward said second surface, said well having a bounding surface.

5. The assembly according to claim 4, further comprising a first gasket being positioned on second surface of said second lid, said first gasket being coextensive with said peripheral wall, said first gasket forming a fluid impermeable seal between said second lid and said container when said second lid is removably coupled to said container.

6. The assembly according to claim 1, further comprising a second gasket being positioned around said shaft, said second gasket being compressed between said knob and said first surface of said second lid such that said second gasket forms a fluid impermeable seal between said second lid and said knob.

7. A beverage stirring assembly being configured to contain a beverage for drinking, said assembly comprising:

a container being configured to contain a liquid, said container having a top end, a bottom end and an outer wall extending therebetween, each of said top end and said bottom end being open, said outer wall having an outer surface, said outer surface being threaded adjacent to said bottom end, said outer surface being threaded adjacent to said top end, said outer wall flaring outwardly along a full length between said bottom end and said top end;

a first lid being removably coupled to said container, said first lid having a first wall and a perimeter wall extending downwardly therefrom, said perimeter wall threadeably engaging said top end of said container, said first lid having an aperture extending through said first wall wherein said aperture is configured to pass the liquid therethrough thereby facilitating the liquid to be drinkable;

a closure being movably coupled to said first lid wherein said closure is configured to be manipulated, said closure being selectively positioned between an open position and a closed position, said closure closing said aperture in said first lid when said closure is positioned in said closed position; and a stirring unit being removably coupled to said container wherein said stirring unit is configured to be manipulated thereby facilitating said stirring unit to stir the liquid, said stirring unit being selectively removed from said container thereby facilitating an interior of said container to be washed, said stirring unit comprising:

a second lid having a primary wall and an peripheral wall extending upwardly therefrom, said peripheral wall having an inside surface, said inside surface threadably engaging said bottom end of said container such that said second lid is removably coupled to said container, said primary wall having a first surface and a second surface, said first surface having a well extending toward said second surface, said well having a bounding surface, a first gasket being positioned on second surface of said second lid, said first gasket being coextensive with said peripheral wall, said first gasket forming a fluid impermeable seal between said second lid and said container when said second lid is removably coupled to said container, a shaft having a first end and a second end, said shaft extending through said primary wall of said second lid having said shaft extending upwardly into said container when said second lid is removably coupled to said container, a knob being coupled to said first end of said shaft wherein said knob is configured to be manipulated, said knob being spaced from said first surface of said second lid thereby inhibiting said shaft from passing through said second lid, a second gasket being positioned around said shaft, said second gasket being compressed between said knob and said first surface of said second lid such that said second gasket forms a fluid impermeable seal between said second lid and said knob, and an agitator being coupled to said second end of said shaft, said agitator comprising a plurality of fins, each of said fins having a long side coupled to said shaft such that each of said fins radiates outwardly from said shaft wherein each of said fins is configured to agitate the liquid in said container when said knob is manipulated, each of said fins having a respective top edge and a respective bottom edge, said top edges of said fins each being straight and upwardly angled extending away from said shaft, said bottom edges of said fins each being straight and upwardly angled extending away from said shaft, each of said fins tapering from said bottom edge to said top edge wherein a smallest diameter of said agitator is positioned adjacent to said top end where an interior diameter of said container is greatest, each of said top edges and said bottom edges being arcuate.

* * * * *